US006631601B1

(12) United States Patent
Roth

(10) Patent No.: US 6,631,601 B1
(45) Date of Patent: Oct. 14, 2003

(54) CHANNEL MEMBER STABILIZER APPARATUS

(76) Inventor: Steven A. Roth, P.O. Box 0933, Alamo, CA (US) 94507

( * ) Notice: Subject to any disclaimer, the term of this patent is extended or adjusted under 35 U.S.C. 154(b) by 0 days.

(21) Appl. No.: 09/852,835

(22) Filed: May 9, 2001

Related U.S. Application Data

(63) Continuation-in-part of application No. 09/841,647, filed on Apr. 24, 2001.

(51) Int. Cl.[7] ..... E04C 3/30

(52) U.S. Cl. ..... 52/730.6; 52/731.7; 52/712; 52/146; 52/714

(58) Field of Search ..... 52/730.6, 731.7, 52/712, 146, 714, 290

(56) References Cited

PUBLICATIONS

Pages 83 & 87 of the Power–Strut Engineering Catalog, Copyright 1987, 1992, 1994, made available by Grinnell Corporation and on.

Pages 84, 86 and 90 of the B–Line Strut Systems Engineering Catalog (BL2R), Copyright 1985 by B–Line Systems, Inc.

Page 108 of the Power–Strut Engineering Catalog.

*Primary Examiner*—Carl D. Friedman
*Assistant Examiner*—Nahid Amiri
(74) *Attorney, Agent, or Firm*—Thomas R. Lampe

(57) ABSTRACT

An attachment member is connected to a channel member to stabilize and restrict movement of the channel member when the channel member is suspended. The attachment member includes a plurality of attachment member plates, at least some of the attachment member plates being angularly disposed relative to one another. One of the plates engages a leg of the channel member and another of the plates projects outwardly from the channel member for attaching stabilizing structure.

10 Claims, 5 Drawing Sheets

CHANNEL MEMBER STABILIZER APPARATUS

This application is a continuation-in-part of U.S. patent application Ser. No. 09/841,647, filed Apr. 24, 2001.

TECHNICAL FIELD

This invention relates to apparatus employed in the building construction industry and more particularly to apparatus for stabilizing a suspended channel member of the type employed, for example, to hold or support pipes, conduits or other components of a building from building structure.

BACKGROUND OF THE INVENTION

Channel members or struts are commonly employed in the building construction industry for a variety of purposes. Channel members are commonly used, for example, with hanger rods, and the channel member depending from the hanger rod is routinely employed to hold or support pipes, conduits or other components of a building from a ceiling or other overhead building structure.

The typical channel member is of elongated construction and includes a channel member base and two spaced, substantially parallel channel member legs attached to the channel member base and extending therefrom. Each of the channel member legs has an inturned lip extending over an interior of the channel defined by the channel member base and the channel member legs. The channel member has two ends defining openings communicating with the channel member interior.

Many different types of hardware or fittings have been devised for use with channel members to accomplish specific objectives. Some of these devices are attached at the ends of a channel member to accomplish such tasks as that of securing the channel member to a beam or other support. Representative examples of fittings are shown, for example, on pages 83 and 87 of the Power-Strut Engineering.Catalog, Copyright 1987, 1992, 1994, made available by Grinnell Corporation, and on pages 84, 86 and 90 of the B-Line Strut Systems Engineering Catalog (BL2R), Copyright 1985 by B-Line Systems, Inc.

It is also known to attach end caps to the ends of channel members for such purposes as to provide a decorative appearance or to prevent concrete from entering the channel member during a concrete pour. Representative ends caps are shown on page 108 of the Power-Strut Catalog indicated above and on page 87 of the B-Line Strut Systems Engineering Catalog noted above. Simple end caps are slipped over channel member ends to function as protective safety covers.

Page 108 of the Power-Strut Engineering Catalog shows a short anchor end cap which functions as a concrete insert that is positioned at an end of a channel member to block concrete from entering the end of the channel member and to provide an outwardly projecting anchor which extends upwardly through the concrete. In other words, the channel member and the short anchor end cap are positioned in situ together and are maintained together as a unit after the concrete has been poured and hardened. There is no fastener means employed in such an arrangement for allowing the short anchor end cap to function with a suspended strut or channel member to stabilize same. The type 'B' end cap shown on the same catalog page is utilized in much the same manner as the short anchor end cap.

None of the prior art fittings is for the purpose of, or suitable for, stabilizing a suspended channel member and restricting movement of the suspended channel member from a location at the end of the channel member. With conventional arrangements, stabilizing structure is connected to a channel member at a location or locations between the ends thereof. This will result in an inability to utilize the maximum effective length of the channel member as a support for support pipes, conduits or other components of a building, as well as interfere with installation of these components on the channel member.

DISCLOSURE OF THE INVENTION

My co-pending U.S. patent application Ser. No. 09/841,647, filed Apr. 24, 2001, indicated above, of which the present application is a continuation-in-part, relates to an approach for bracing a suspended channel member against movement due to earthquakes and the like while enabling the user to employ the full length of the channel member to provide support for pipes, conduits or other components of a building. The present invention relates to another approach for accomplishing this objective.

The present invention encompasses a combination including an elongated channel member having a channel member base and first and second spaced, substantially parallel channel member legs attached to the channel member base and extending therefrom. Each of the channel member legs has an inturned lip extending over a channel member interior defined by the channel member base and the channel member legs.

An attachment member is connected to the channel member. The attachment member is comprised of a plurality of attachment member plates secured together and located at the channel member end.

At least some of the attachment member plates are angularly disposed relative to one another with a first attachment member plate in engagement with the channel member and a second attachment member plate projecting outwardly from the channel member for attaching stabilizing structure to the channel member when the channel member is suspended to stabilize and restrict movement of the suspended channel member.

Other features, advantages and objects of the present invention will become apparent with reference to the following description and accompanying drawings.

MODES FOR CARRYING OUT THE INVENTION

Figure 1:
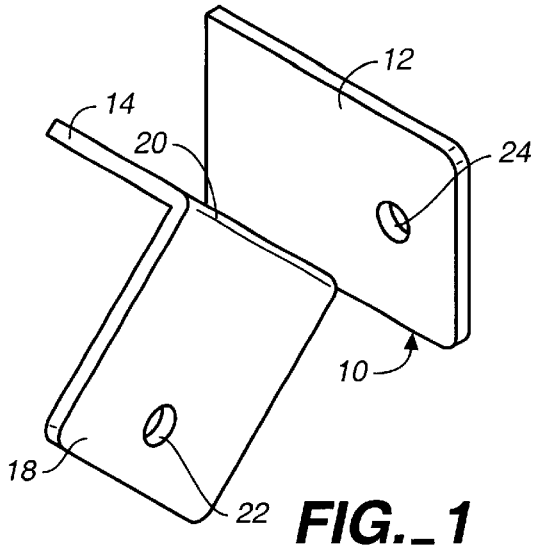
FIG. 1 is a perspective view of an embodiment of an attachment member constructed in accordance with the teachings of the present invention.

Referring now to FIGS. 1–4, an attachment member constructed in accordance with the teachings of the present invention is designated by reference numeral 10. Attachment member 10 is of integral construction, being suitably formed of sheet metal shaped and bent to the illustrated configuration.

Attachment member 10 includes an attachment member plate 12, an attachment member plate 14 affixed to attachment member plate 12 along a bend line 16 and angularly disposed relative thereto and an attachment member plate 18. Attachment member plate 18 is integrally connected to plate 14 along a bend line 20 and is angularly disposed relative thereto. More particularly, in the illustrated embodiment, plate 18 is orthogonally disposed relative to plate 14. An opening 22 is defined by plate 18. Likewise, an opening 24 is defined by plate 12.

Figure 3:
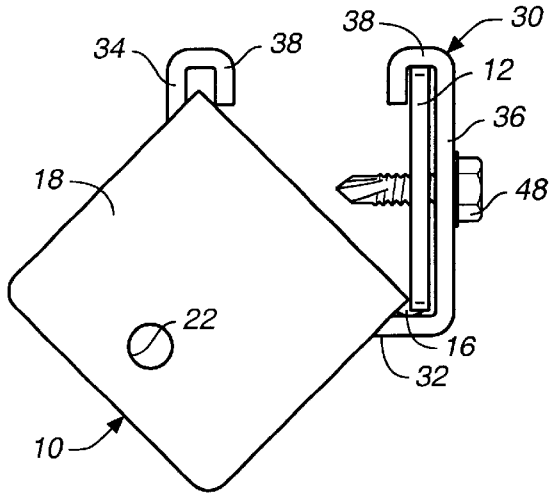
FIG. 3 is an end elevational view showing the attachment member connected to the channel member and fastened thereto by the screw.
Figure 2:
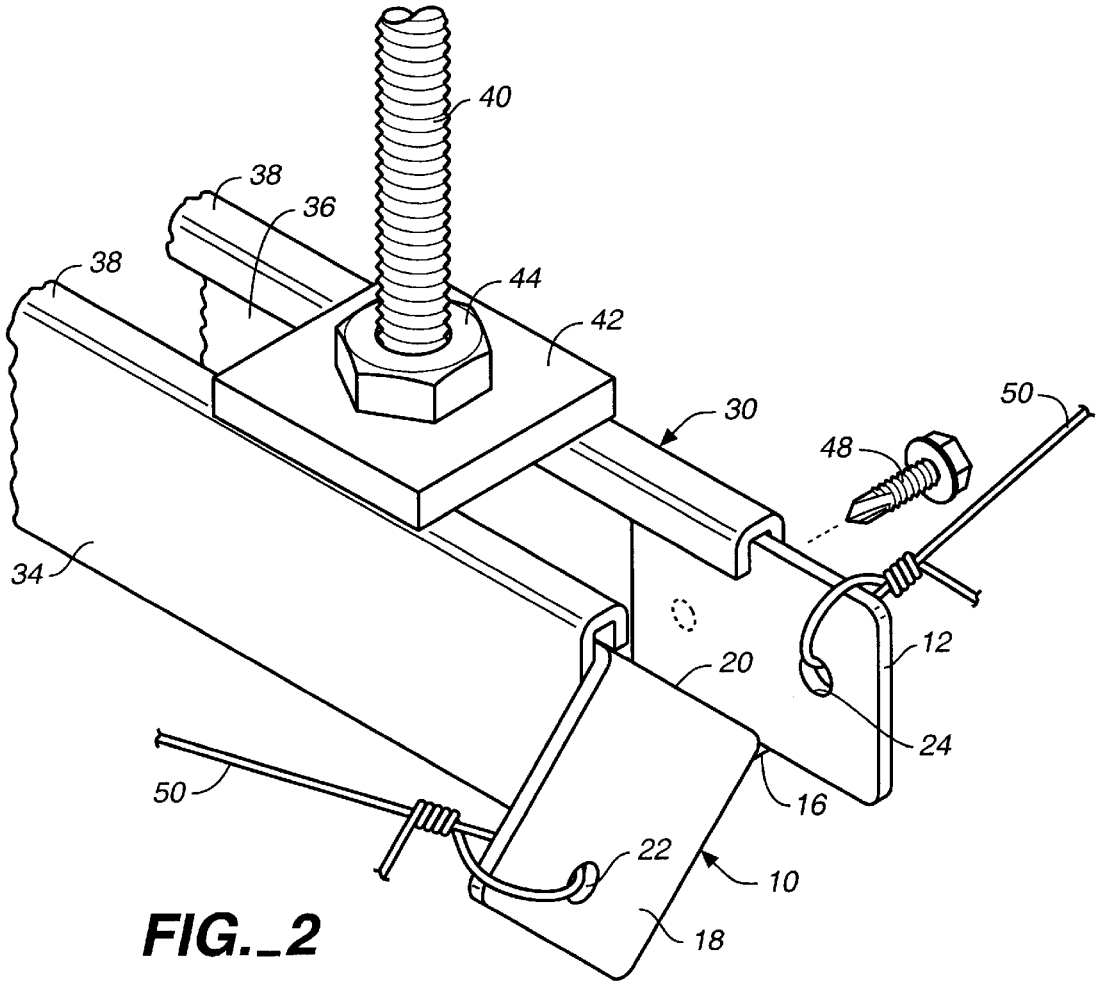
FIG. 2 is a perspective view illustrating the attachment member fastened at the end of a channel member and connected to stabilizing structures in the form of wire bracing, a threaded screw being shown prior to fastening the channel member to the attachment member.
Figure 4:
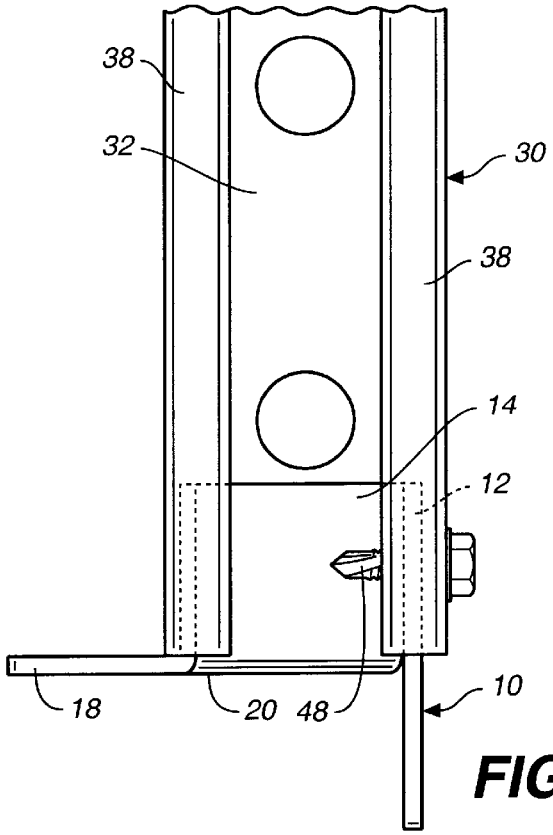
FIG. 4 is a top plan view of the attachment member fastened to an end of the channel member.

FIGS. 2, 3 and 4 illustrate attachment member 10 fastened in position at one end of a channel member 30, a portion of the latter being shown. The channel member 30 is of conventional construction.and includes a channel member base 32 having two channel member legs 34, 36 attached thereto and extending therefrom. Each of the channel member legs has an inturned lip 38 extending over the interior of the channel member defined by the base 32 and legs 34, 36. The ends of the channel member, including the end at which the attachment member 10 is positioned, are open and communicate with the channel member interior.

FIG. 2 shows the channel member 30.supported by a threaded hanger rod 40 in a conventional manner. In the arrangement illustrated, the hanger rod 40 passes through the channel member and through a rectangular-shaped washer 42 disposed above the channel member. Also as is conventional, a nut 44 engages a washer 42. Another nut (not shown) is threadedly engaged with the lower end of the hanger rod to secure the hanger rod in position relative to the channel member.

When the attachment member 10 is in the position shown in FIGS. 2, 3 and 4, the plate 12 is in engagement with the channel member and disposed parallel and closely adjacent to channel member leg 36. The plate 12 is positioned under the inturned lip 38 thereof for limiting upward movement of the plate 12 relative to the channel member. Also, since the upper end of plate 12 is disposed in the recess defined by the lip and channel member leg it is captured therein and cannot tilt relative to the channel member leg.

Plate 14 extends from the plate 12 to a location under the inturned lip 38 of channel member leg 34 to restrict relative movement between the third attachment member plate and the channel member. In other words, with the arrangement illustrated, the upper ends of both plates 12 and 14.have their movement restricted by the lips 38 of the channel member. Preferably, the plates 12 and 14 are sized and configured to lockingly engage with the channel member when engaging their respective lips 38.

FIG. 2 shows stabilizing structure in the form of wire braces 50 attached to plates 12 and 18 at holes 22, 24 thereof. The distal ends of the wire braces form loops and are wrapped about the straight segments of the wire braces. The upper ends of the braces project to a ceiling or other overhead building structure (not shown).

In the embodiment of FIGS. 1–4, fastener means is employed to more positively fasten the attachment member to the channel member. This fastener means is in the form of a self-drilling tapping screw which is threadedly engaged with the channel member and is in locking engagement with plate 12. FIG. 2 shows the screw 48 prior to application thereof, a dash line representation being made of the area of plate 12 which receives the screw.

Figure 5:
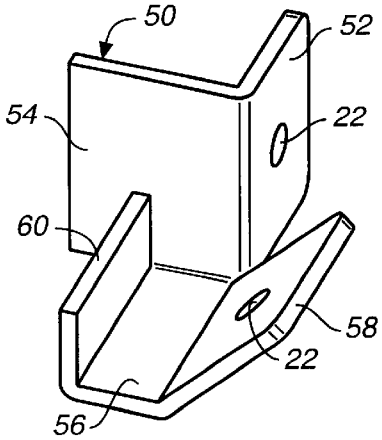
FIG. 5 is a view similar to FIG. 1 but illustrating a second embodiment of the attachment member.
Figure 6:
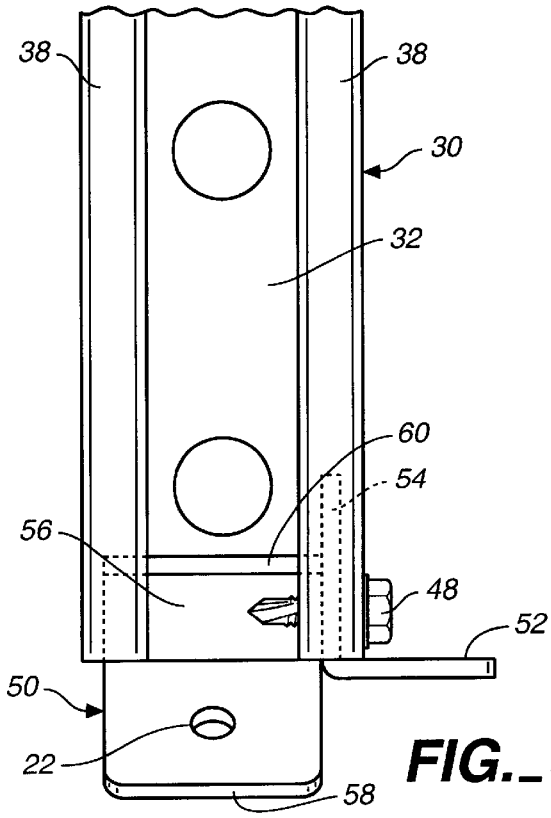
FIG. 6 is a view similar to FIG. 4 showing the embodiment of FIG. 5 fastened to an end of a channel member.

FIGS. 5 and 6 show another embodiment of the invention in which the attachment member is designated by reference numeral 50. In this embodiment of the invention, five integrally connected plates 52, 54, 56, 58 and 60 are employed. Plate 54 is disposed under one of the lips 38 of the channel member with plate 52 affixed directly to plate 50 projecting from the channel member orthogonally relative to plate 54. Plate 56 is disposed on the base 32 of the channel member and extends in the direction of the other leg of the channel member. Plate 56 is connected to plate 54 along a bend line.

Plate 58 is connected to plate 56 along a bend line and is disposed at an angle relative thereto, plate 58 projecting from the end of the channel member. Plate 60 is bent upwardly from plate 56 and is disposed alongside plate 54 to provide stability. Holes 22 formed in plates 52 and 58 are used to attach the attachment member 50 to stabilizing structure. In this embodiment a screw 48 fastens plate 54 to a channel member leg.

Figure 7:
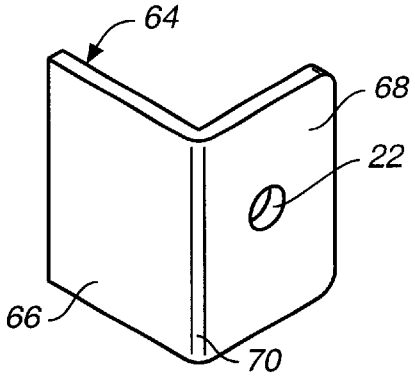
FIG. 7 is a view similar to FIG. 5 but illustrating a third embodiment of attachment member.
Figure 8:
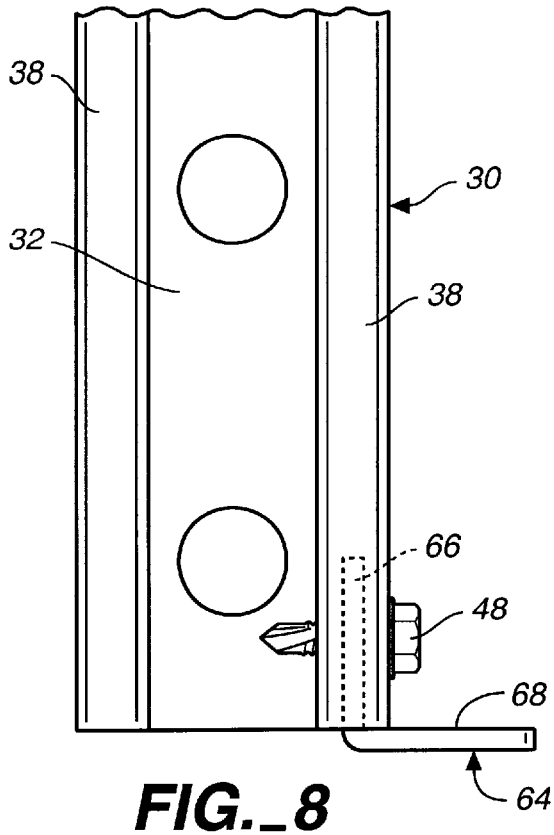
FIG. 8 is a top plan view illustrating the attachment member of FIG. 7 fastened to a channel member end.

In the embodiment of FIGS. 7 and 8, attachment member 64 is comprised of two attachment member plates 66, 68 orthogonally disposed relative to one another and attached along a bend line 70. Plate 66 is disposed under one of the lips 38 and fastened in place at that location by a screw 48. Plate,68 projects from the open end of the channel member. An opening 22 can be utilized to attach the attachment member 64 and the channel member to a wire brace (not shown).

Figure 9:
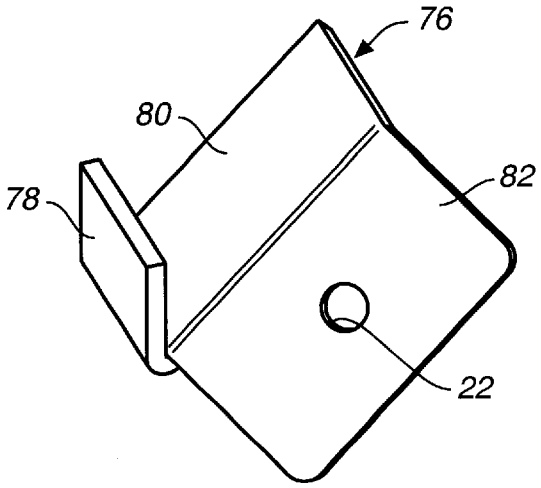
FIG. 9 is a perspective view of a fourth embodiment of the attachment member.
Figure 10:
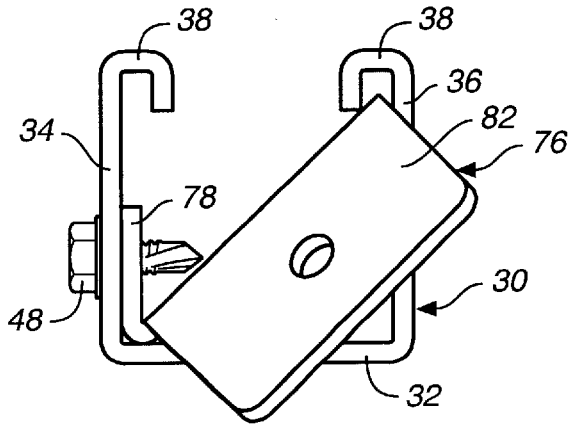
FIG. 10 is an elevational end view showing the fourth embodiment fastened to a channel member.

FIGS. 9 and 10 depict an attachment member 76 including three attachment member plates 78, 80, 82, the latter having an opening 22 therein. Plates 80 and 82 are integrally connected along a bend line and are angularly disposed relative to one another. Plates 80 and 78 are integrally connected along a bend line and also are angularly disposed relative to one another.

FIG. 10 shows attachment member 76 installed in a channel member. A screw 48 fastens plate 78 directly to leg 34. Plate 80 extends upwardly into engagement with the lip 38 of leg 36, the upper end of plate 80 thus being captured and being maintained in position by leg 36 and the lip 38 thereof. Plate 82 projects from the end of the channel member, as shown.

Figure 11:
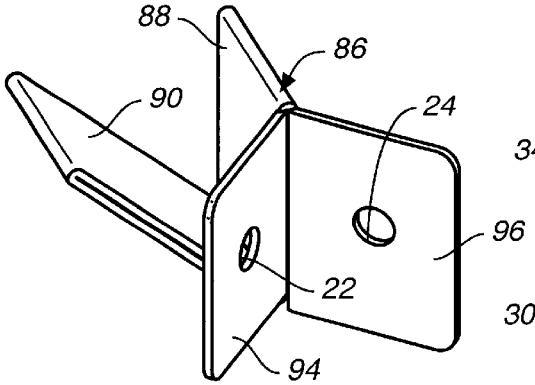
FIG. 11 is a perspective view illustrating a fifth embodiment of the attachment member.
Figure 12:
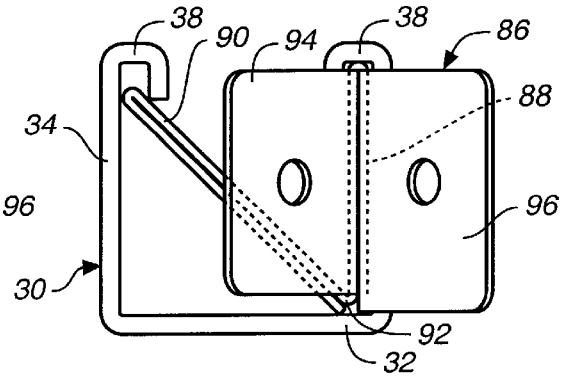
FIG. 12 is an elevational end view illustrating the attachment member of FIG. 11 connected to a channel member.

FIGS. 11 and 12 illustrate yet another embodiment of the attachment member of this invention, attachment member 86. This embodiment includes an attachment member plate 88 and an attachment member plate 90.

Plates 88 and 90 are each of double-ply construction, plates 88 and 90 being angularly disposed relative to one another and integrally attached at a bend line 92.

Plate 88 is positioned under one of the lips 38 of the channel member 30, being disposed parallel and adjacent to the leg associated with that lip. Plate 90 is angularly disposed relative to plate 88 and the uppermost or distal end thereof is positioned under lip 38 of leg 34. The plates 88 and 90 are sized and configured so that they frictionally engage the channel member to maintain attachment member 86 in place. Plates 88, 90 may be thought of as comprising elements of a retainer clip interconnecting the attachment member 86 and the channel member.

One of the plies of plate 88 is integrally connected to a plate 94. The other ply is integrally attached to a plate 96. Plates 94, 96 diverge away from one another and project outwardly from the channel member 30. Openings 22, 24 formed in the plates 94, 96, respectively, are utilized to accommodate stabilizing structure.

Figure 13:
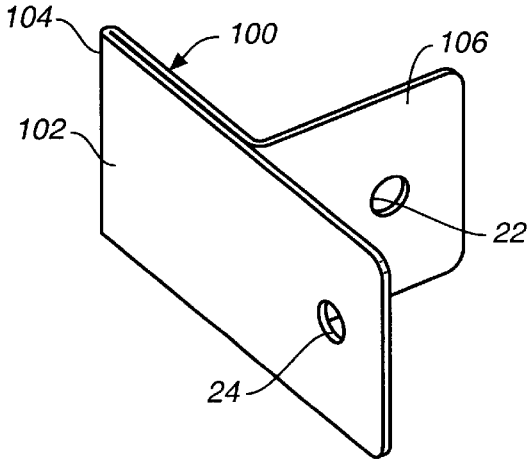
FIG. 13 is a perspective view illustrating a sixth embodiment of an attachment member constructed in accordance with the teachings of the present invention.
Figure 14:
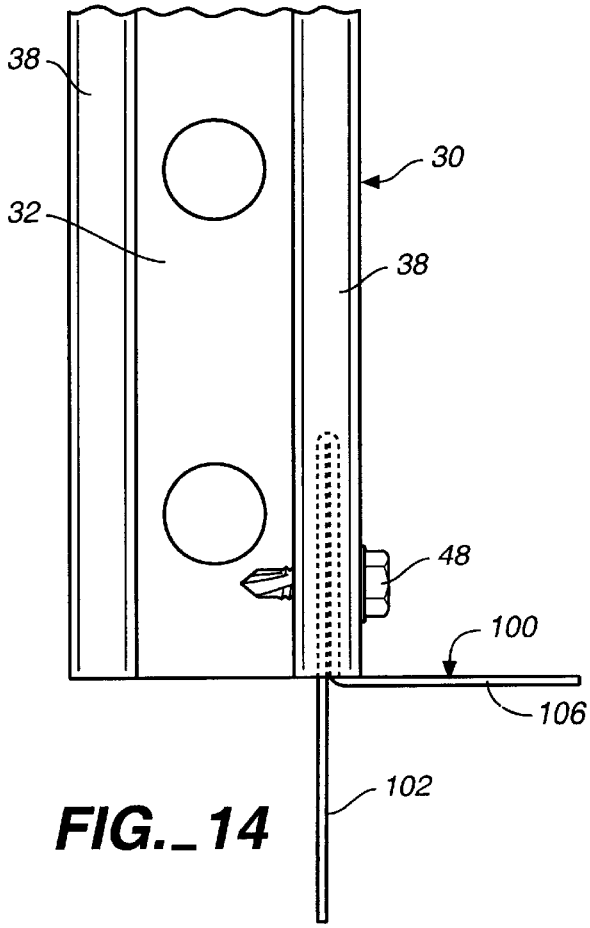
FIG. 14 is a top plan view illustrating the embodiment of FIG. 13 fastened to a channel member.

FIGS. 13 and 14 illustrate an attachment member.100 including a plate 102 which is bent at bend 104 to make the plate of double-ply construction over a portion of the length thereof. One of the plies is bent to form attachment plate 106 which is disposed orthogonally relative to plate 102. The plate 106 has an opening 22 therein. An opening 24 is formed ion the single-ply segment of plate 102.

FIG. 14 shows attachment member 100 in place on a channel member. The double-ply portion of the plate 102 is disposed under one of the lips 38 thereof and a screw 48 fastens the two-ply portion of plate 102 to a channel member leg. The single wall portion of plate 102 projects from the end of the channel member as does plate 106 orthogonally disposed relative thereto. The openings in these projecting elements are employed to stabilize the channel member.

Figure 15:
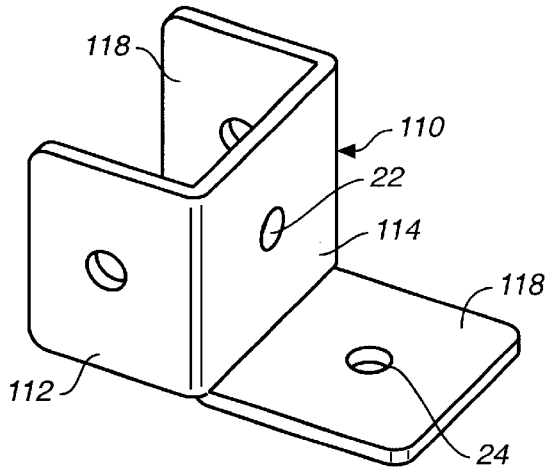
FIG. 15 is a perspective view illustrating a seventh embodiment of the attachment member.
Figure 16:
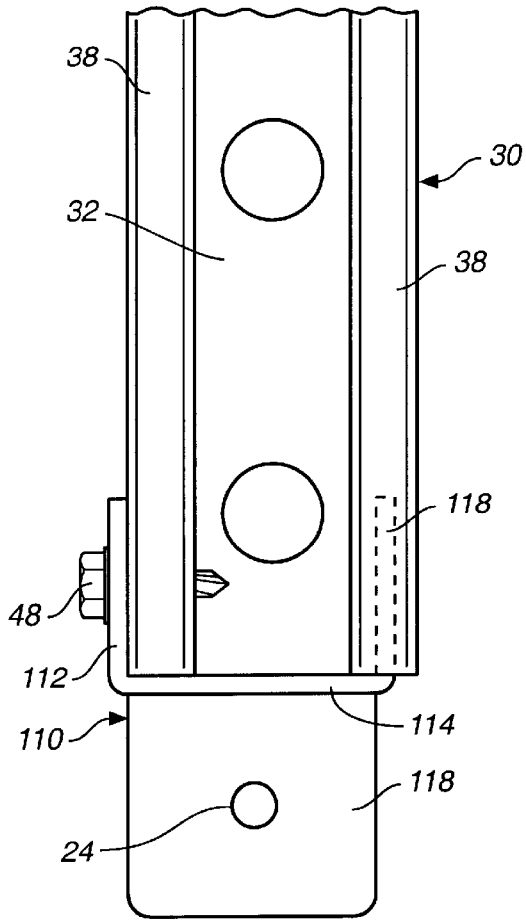
FIG. 16 is a top plan view illustrating the embodiment of FIG. 15 fastened to a channel member.

FIGS. 15 and 16 show yet another embodiment of the invention, attachment member 110. In this embodiment of the invention three attachment member plates 112, 114 and 118 are formed to provide a U-shaped configuration. A fourth plate 118 is integrally attached to plate 114 and projects orthogonally with respect thereto.

A screw 48 is employed,to attach plate 112 to a leg of the channel member, as shown in FIG. 16. The plate 112 is disposed externally of the channel member. Plate 114 extends over the open end of the channel member and plate 118 is positioned inside the channel member under one of the lips 38 thereof. The holes 22, 24 formed in plates 114 and 118 provide for interconnection with brace wires or other stabilizing structure.

The invention claimed is:

1. In combination:

an elongated channel member including a channel member base and spaced, substantially parallel first and second channel member legs attached to said channel merger base and extending therefrom, each of said channel member legs having an internal lip extending over a channel member interior defined by said channel member base and said channel member legs, and said channel member having an end defining an end opening communicating with said channel member interior; and an attachment member connected to said channel member, said attachment member being comprised of a plurality of attachment member plates secured together and located at the channel member end, at least some of said attachment member plates being angularly disposed relative to one another with a first attachment member plate in engagement with said channel member and a second attachment member plate projecting outwardly from said channel member for attaching stabilizing structure to said channel member when said channel member is suspended to stabilize and restrict movement of the suspended channel member, said first attachment member plate disposed parallel and closely adjacent to said first channel member leg and positioned under the inturned lip thereof limiting upward movement of said attachment member relative to said channel member, and said attachment member including a third attachment member plate attached to said first attachment member plate and extending therefrom to a location under the inturned lip of the second channel member leg to restrict relative movement between said third attachment member plate and said channel member, said second attachment member plate being affixed to and extending from either said first attachment plate or said third attachment member plate beyond the end of said channel member.

2. The combination according to claim 1 wherein said first, second and third attachment member plates are angularly disposed relative to one another.

3. The combination according to claim 1 wherein said second attachment member plate defines an opening for receiving said stabilizing structure.

4. The combination according to claim 1 additionally comprising fastener means fastening said attachment member to said channel member.

5. The combination according to claim 4 wherein said fastener means comprises a threaded fastener passing through said channel member and said first attachment member plate.

6. An attachment member for connection to an elongated channel member to stabilize and restrict movement thereof when said channel member is suspended, said channel member including a channel member base and first and second spaced, substantially parallel channel member legs attached to said channel member base and extending therefrom, each of said channel member legs having an inturned lip extending over a channel member interior defined by said channel member base and said channel member having an end defining an end opening communicating with said channel member interior, said attachment member for positioning at the channel member end and comprised of a plurality of attachment member plates, at least some of said attachment member plates being angularly disposed relative to one another with a first attachment member plate for engagement with said channel member and a second attachment member plate for protecting outwardly from the channel member when said first attachment member plate is in engagement with the channel member for attaching stabilizing structure to said channel member when said channel member is suspended to stabilize and restrict movement of the suspended channel member, said first channel member plate sized and configured for positioning of said first channel member plate under the inturned lip of a first channel member leg when said first attachment member plate is disposed parallel and closely adjacent to said first channel member leg to limit upward movement of said attachment member relative to said channel member, said attachment member additionally including a third attachment member plate attached to said first attachment member plate, said third attachment member plate being sized and configured to extend from the first attachment member plate to a location under the inturned lip of the second channel member leg when said first attachment member plate is disposed parallel and closely adjacent to said first channel member leg to restrict relative movement between said third attachment member plate and said channel member, said second attachment member plate being affixed to and extending from either said first attachment member plate or said third attachment member plate.

7. The attachment member according to claim to claim 6 wherein said first, and second and third attachment member plates are angularly disposed relative to one another.

8. The attachment member according to claim 6 wherein said second attachment member plate defines an opening for receiving said stabilizing structure.

9. The attachment member according to claim 6 wherein said plurality of attachment member plates are integrally connected.

10. The attachment member according to claim 9 wherein said plurality of attachment.member plates are separated by bends.

* * * * *